US011017713B2

(12) United States Patent
Chu et al.

(10) Patent No.: US 11,017,713 B2
(45) Date of Patent: May 25, 2021

(54) PIXEL CIRCUIT, SENSING METHOD FOR PIXEL CIRCUIT, AND DISPLAY PANEL

(71) Applicant: BOE TECHNOLOGY GROUP CO., LTD., Beijing (CN)

(72) Inventors: Mingi Chu, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/621,310

(22) PCT Filed: May 10, 2019

(86) PCT No.: PCT/CN2019/086471
§ 371 (c)(1),
(2) Date: Dec. 11, 2019

(87) PCT Pub. No.: WO2019/214735
PCT Pub. Date: Nov. 14, 2019

(65) Prior Publication Data

US 2020/0098306 A1 Mar. 26, 2020

(30) Foreign Application Priority Data

May 11, 2018 (CN) ..... 201810450593.X

(51) Int. Cl.
*G09G 3/325* (2016.01)
*G09G 3/32* (2016.01)

(52) U.S. Cl.
CPC ..... *G09G 3/32* (2013.01); *G09G 2310/0267* (2013.01); *G09G 2310/0275* (2013.01); *G09G 2310/0289* (2013.01)

(58) Field of Classification Search
CPC ..... G09G 3/3233; G09G 2320/0295; G09G 3/3291; G09G 3/3258; G09G 2320/0233;
(Continued)

(56) References Cited

U.S. PATENT DOCUMENTS 9,972,252 B2 5/2018 Choi et al.
10,062,327 B2 8/2018 Tani et al.
(Continued)

FOREIGN PATENT DOCUMENTS

CN 105144273 12/2015
CN 106205496 12/2016
(Continued)

OTHER PUBLICATIONS

International Search Report and Written Opinion dated Jul. 30, 2019 for PCT Patent Application No. PCT/CN2019/086471.
(Continued)

*Primary Examiner* — Duc Q Dinh
(74) *Attorney, Agent, or Firm* — Thomas | Horstemeyer, LLP

(57) ABSTRACT

The present disclosure relates to the field of display technologies, and provides a pixel circuit including: a display pixel driving circuit, a sensing line, and at least one non-display pixel driving circuit. The display pixel driving circuit is configured to drive a display sub-pixel, and includes a first driving transistor. The sensing line is coupled to an output end of the first driving transistor, and configured to sense a current of an output end of the first driving transistor; each of the non-display pixel driving circuits is configured to drive one non-display sub-pixel, and the non-display pixel driving circuit includes a second driving transistor. An output end of the second driving transistor is coupled to the sensing line to input a compensation current to the sensing line.

16 Claims, 4 Drawing Sheets

(58) Field of Classification Search
CPC ..... G09G 2320/045; G09G 2320/043; G09G 2300/043; G09G 2320/029; G09G 2310/061; G09G 2320/0693; G09G 2330/021; G09G 2300/0413; G09G 2300/0439; G09G 2320/0257; G09G 2320/0633; G09G 2320/0204; G09G 2360/04; G09G 2360/14; G09G 3/2074; G09G 3/3208; G09G 3/3241; G09G 2300/0443; G09G 2300/0809; G09G 2310/0267; G09G 2310/0275; G09G 2310/0289; G09G 2330/10; G09G 2330/12; G09G 3/32; G09G 3/3225
See application file for complete search history.

(56) References Cited

U.S. PATENT DOCUMENTS

| | | | | |
|---|---|---|---|---|
| 10,170,044 | B2 | 1/2019 | Park et al. | |
| 10,319,286 | B2 | 6/2019 | Do et al. | |
| 2006/0208971 | A1* | 9/2006 | Deane | G09G 3/3233 345/76 |
| 2014/0361960 | A1* | 12/2014 | Yamauchi | G09G 3/3233 345/76 |
| 2016/0086548 | A1 | 3/2016 | Maeyama | |
| 2016/0351096 | A1* | 12/2016 | Tani | G09G 3/3233 |
| 2017/0061865 | A1* | 3/2017 | Park | G09G 3/325 |
| 2017/0154579 | A1 | 6/2017 | Choi et al. | |
| 2018/0122294 | A1 | 5/2018 | Do et al. | |
| 2018/0122302 | A1* | 5/2018 | Koong | G09G 3/3275 |

FOREIGN PATENT DOCUMENTS

| | | |
|---|---|---|
| CN | 106486059 | 3/2017 |
| CN | 106816135 | 6/2017 |
| CN | 108010488 | 5/2018 |
| CN | 108630140 | 10/2018 |
| EP | 3316241 | 5/2018 |
| TW | 200421221 | 10/2004 |
| WO | 2004088626 | 10/2004 |

OTHER PUBLICATIONS

1st Office Action dated Nov. 13, 2019 for Chinese Patent Application No. 201810450593.X.
2nd Office Action dated Mar. 30, 2020 for Chinese Patent Application No. 201810450593.X.

* cited by examiner

PIXEL CIRCUIT, SENSING METHOD FOR PIXEL CIRCUIT, AND DISPLAY PANEL

CROSS-REFERENCE TO RELATED APPLICATIONS

The present application is based upon International Application No. PCT/CN19/086471, filed on May 10, 2019, which is based upon and claims priority to Chinese Patent Application No. 201810450593.X, entitled "PIXEL CIRCUIT, PIXEL CIRCUIT SENSING METHOD AND DISPLAY PANEL", filed on May 11, 2018, the entire contents of which are hereby incorporated by reference.

TECHNICAL FIELD

The present disclosure relates to the field of display technologies and, in particular, to a pixel circuit, a pixel circuit sensing method, and a display panel.

BACKGROUND

Generally, a pixel circuit includes a display unit, a driving transistor, and a light emitting unit. An output end of the driving transistor is coupled to the light emitting unit, and an input end of the driving transistor receives a data signal to control a voltage of the output end thereof. In the related art, the driving transistor generally adopts a thin film transistor. However, a threshold voltage and mobility of the thin film transistor may shift during operation, thereby causing a deviation in the voltage at the output end of the thin film transistor, and then the luminance of the light emitting unit is deviated. In the related art, the threshold voltage and mobility of the driving transistor are usually compensated by means of pixel internal compensation.

However, internal compensation has certain limitations. When the internal compensation cannot meet the compensation requirement, the threshold voltage and mobility of the driving transistor need to be compensated by external compensation. In the external compensation technique, it is necessary to sense a current or voltage of the output end of the driving transistor during the sensing period through a sensing line for calculating a compensation voltage.

However, as the refresh rate of the display screen gradually increases, charging time of the driving transistor becomes shorter and shorter, and the current and voltage input to the sensing line by the driving transistor during the sensing become smaller and smaller. A digital-to-analog converter coupled to the sensing line cannot sense the current or voltage on the sensing line, and thus cannot calculate the compensation voltage The information disclosed in the Background section above is only for enhancing the understanding of the background of the present disclosure, and thus may include information that does not constitute prior art known to those of ordinary skill in the art.

SUMMARY

The present disclosure provides a pixel circuit, a pixel circuit sensing method, and a display panel.

According to an aspect of the present disclosure, there is provided a pixel circuit, including a display pixel driving circuit, a sensing line, and at least one non-display pixel driving circuit. The display pixel driving circuit is configured to drive a display sub-pixel, and includes a first driving transistor. The sensing line is coupled to an output end of the first driving transistor, and is configured to sense a current of the output end of the first driving transistor. Each of the non-display pixel driving circuit is configured to drive one non-display sub-pixel, and includes a second driving transistor with an output end coupled to the sensing line to input a compensation current to the sensing line.

In some exemplary embodiments of the present disclosure, the pixel circuit further includes a controllable voltage source, which is coupled to a control end of the second driving transistor and configured to control the output end of the second driving transistor to output a preset compensation current.

In some exemplary embodiments of the present disclosure, the display pixel driving circuit has a same circuit structure as the non-display pixel driving circuit, and a voltage of the controllable voltage source is less than a first preset threshold.

In some exemplary embodiments of the present disclosure, the output end of the second driving transistor of the non-display pixel driving circuit is not coupled to a light emitting unit, and the voltage of the controllable voltage source is greater than or equal to a second preset threshold.

In some exemplary embodiments of the present disclosure, the controllable voltage source is provided by a source driving circuit of the display sub-pixel or an external power source.

In some exemplary embodiments of the present disclosure, the pixel circuit further includes an external driving unit, which is configured to drive the second driving transistor to supply the compensation current to the sensing line when the sensing line senses an output current of the first driving transistor.

According to an aspect of the present disclosure, there is provided a pixel circuit sensing method, including: sensing an output current of a first driving transistor in a display pixel driving circuit by using a sensing line; and outputting a compensation current to the sensing line by using at least one non-display pixel driving circuit during the sensing an output current of a first driving transistor in a display pixel driving circuit by using a sensing line.

According to an aspect of the present disclosure, there is provided a display panel, including the pixel circuit as described above.

In some exemplary embodiments of the present disclosure, the display panel includes a plurality of display pixels arranged in rows and columns, each of the display pixels includes a plurality of display sub-pixels, and the plurality of display sub-pixels in each of the display pixels are coupled to a same sensing line. One sensing line is coupled to at least one non-display sub-pixel.

In some exemplary embodiments of the present disclosure, the display panel includes at least one row of non-display sub-pixels, a number of the non-display sub-pixels in each row is equal to the number of the display sub-pixels in each row; or the number of the non-display sub-pixels in each row is equal to ½, ⅓, or ¼ of the number of the display sub-pixels in each row.

It should be understood that the above general description and the following detailed description are intended to be illustrative and not restrictive.

BRIEF DESCRIPTION OF THE DRAWINGS

The accompanying drawings, which are incorporated in the specification and constitute a part of the specification, show exemplary embodiments of the present disclosure. The drawings along with the specification explain the principles of the present disclosure. It is apparent that the drawings in the following description show only some of the embodiments of the present disclosure, and other drawings may be obtained by those skilled in the art without departing from the drawings described herein.

DETAILED DESCRIPTION

Figure 1:
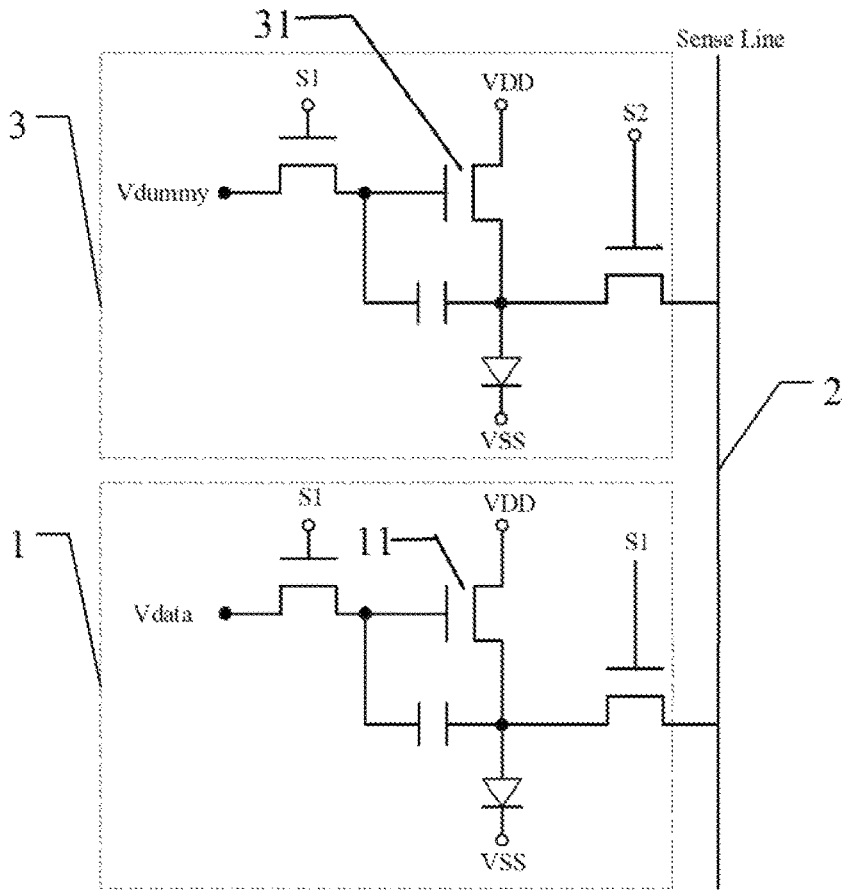
FIG. 1 is a schematic structural diagram of a pixel circuit according to one or more embodiments of the present disclosure.

Example embodiments will now be described more fully with reference to the accompanying drawings. However, the example embodiments can be implemented in a variety of forms and should not be construed as being limited to the examples set forth herein; rather, these embodiments are provided so that this disclosure will be more complete so as to convey the idea of the example embodiments to those skilled in this art. The same reference numerals in the drawings denote the same or similar parts, and the detailed description thereof will be omitted.

Although relative terms such as "above" and "below" are used in the specification to describe the relative relationship of one component to another component shown, these terms are only for convenience in this specification, for example, according to an exemplary direction shown in the drawings. It will be understood that if the device shown is flipped upside down, the component described "above" will become the component "below". Other relative terms, such as "high", "low", "top", "bottom", "left", "right", etc., also have similar meanings. When a structure is "on" another structure, it may mean that the structure is integrally formed on another structure, or that the structure is "directly" disposed on another structure, or that the structure is "indirectly" disposed on another structure through other structures.

In the present specification, the terms "one", "a", "the", and "said" are used to indicate that there are one or more elements/components or the like; the terms "include", "contain" and "have" are used to indicate an open type meaning of including and means that there may be additional elements/components/etc. in addition to the listed elements/components/etc.

The present exemplary embodiment provides a pixel circuit, as shown in FIG. 1, which is a schematic structural diagram of an exemplary embodiment of the pixel circuit of the present disclosure. The pixel circuit includes a display pixel driving circuit 1, a sensing line 2, and a non-display pixel driving circuit 3. The display pixel driving circuit 1 is configured to drive a display sub-pixel, and the display pixel driving circuit includes a first driving transistor 11. The sensing line 2 is coupled to an output end of the first driving transistor 11, and is configured to sense a current of the output end of the first driving transistor 11. The non-display pixel driving circuit 3 is configured to drive a non-display sub-pixel, and the non-display pixel driving circuit 3 includes a second driving transistor 31. An output end of the second driving transistor 31 is coupled to the sensing line 2 to input a compensation current to the sensing line 2. The sensing line 2 is coupled with an analog-to-digital converter (not shown), which is configured to sense a current on the sensing line.

The pixel circuit proposed by the present disclosure provides the compensation current to the sensing line through the non-display pixel driving circuit, so that the current on the sensing line is within the sensing range of the digital-to-analog converter during sensing, thereby obtaining the output current of the first driving transistor in the display pixel driving circuit during the sensing by the difference between the total current on the sensing line and the compensation current. On one hand, the pixel circuit can implement current sensing when the output current of the first driving transistor is small; on the other hand, the pixel circuit has a simple structure and low cost.

In other exemplary embodiments, there may be provided a plurality of non-display pixel driving circuits, and the output ends of the driving transistors in the plurality of non-display pixel driving circuits are simultaneously coupled to the sensing line, and the plurality of non-display pixel driving circuits apply the compensation current to the sensing line simultaneously.

In the exemplary embodiment, as shown in FIG. 1, the circuit structure of the display pixel driving circuit 1 may be a 3T1C structure. In other exemplary embodiments, for the circuit structure of the display pixel driving circuit 1, there exists more options, such as 4T1C, 7T1C, etc.; similarly, in the exemplary embodiment, the non-display pixel driving circuit 3 can be selected as a 3T1C structure. In other exemplary embodiments, for the circuit structure of the non-display pixel driving circuit 3, there exists more options, such as 4T1C, 7T1C, etc. These all belong to the protection scope of the present disclosure.

In the exemplary embodiment, the pixel circuit may further include a controllable voltage source (not shown) coupled to the control end of the second driving transistor 31 and being configured to control the output end of the second driving transistor 31 to output a preset compensation current. As shown in FIG. 1, the controllable voltage source can provide a controllable voltage Vdummy to the control end of the second driving transistor 31. By adjusting the magnitude of the controllable voltage Vdummy, a preset magnitude of the compensation current Idummy can be obtained. The current at the output end of the first driving transistor 11 during the sensing can be obtained by subtracting the compensation current Idummy from the total current Itotal sensed by the sensing line 2. In other exemplary embodiments, the compensation current can also be obtained by sensing through the sensing line, which is all belong to the protection scope of the present disclosure.

In order to save cost, in the exemplary embodiment, the circuit structures of the display pixel driving circuit 1 and the non-display pixel driving circuit 3 may be the same. The non-display pixel driving circuit 3 may directly use the circuit structure of the display pixel driving circuit 1 to save cost. When the structures of the non-display pixel driving circuit 3 and the display pixel driving circuit 1 are the same, the controllable voltage Vdummy output by the controllable voltage source needs to be smaller than a first preset threshold, thereby preventing the light emitting unit of the non-display pixel driving circuit 3 from emitting light. In the present exemplary embodiment, the voltage across the light-emitting unit in the non-display pixel driving circuit 3 may be larger than the voltage across the light-emitting unit in the display pixel driving circuit, thereby ensuring that the compensation current Idummy is increased on the premise that the light-emitting unit in the non-display pixel driving circuit 3 does not emit light. In other exemplary embodiments, the non-display pixel driving circuit 3 may not be provided with the light emitting unit, and the controllable voltage Vdummy output by the controllable voltage source may be an arbitrary value. In order to ensure that the total current Itotal of the sensing line 2 is within the detection range of the digital-to-analog detector, the controllable voltage Vdummy output by the controllable voltage source may be greater than or equal to a second preset threshold. The sum of the compensation current Idummy outputted by the second driving transistor and the current Idisplay outputted by the first driving transistor is within the detection range of the digital-to-analog detector with the controllable voltage Vdummy being the second preset threshold. The controllable voltage source may be provided by a source driving circuit of the display sub-pixel or may be provided by an external power source.

In the exemplary embodiment, the pixel circuit further includes an external driving unit (not shown), configured to drive the second driving transistor to supply the compensation current to the sensing line during the sensing line sensing an output current of the first driving transistor. As shown in FIG. 1, the external driving unit may supply scan signals S1, S2 to the non-display pixel driving circuit 3, and the non-display pixel driving circuit 3 may drive the second driving transistor to supply the compensation current to the sensing line during the sensing line sensing the output current of the first driving transistor under the control of the scanning signals S1, S2.

Figure 2:
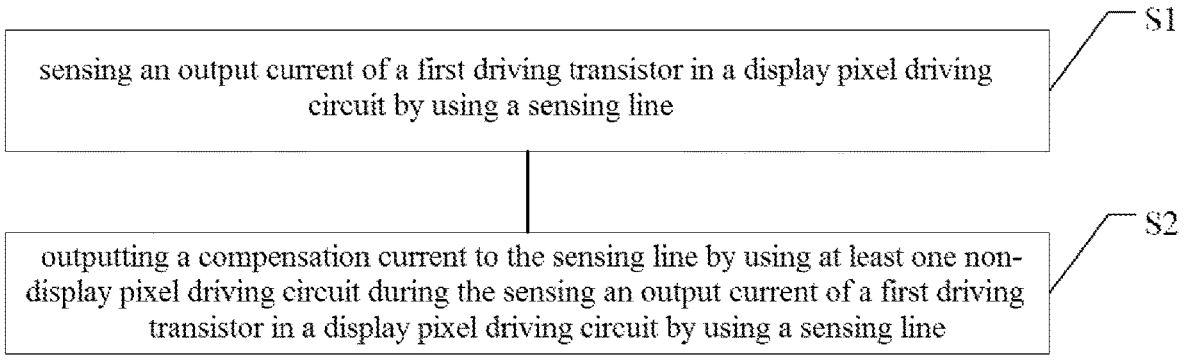
FIG. 2 is a flow chart of a pixel circuit sensing method according to one or more embodiments of the present disclosure.

The pixel circuit according to the present disclosure provides the compensation current to the sensing line through the non-display pixel driving circuit, so that the sensing line can perform current sensing with a small current at the output end of the first driving transistor during sensing, thereby achieving external compensation for the threshold and mobility of the driving transistor of the pixel driving circuit in the high refresh rate displays The present exemplary embodiment further provides a pixel circuit sensing method, as shown in FIG. 2, which is a flowchart of an exemplary embodiment of a pixel circuit sensing method of the present disclosure. The method includes the following steps.

In step S1, an output current of a first driving transistor in a display pixel driving circuit is sensed by using a sensing line.

In step S2, a compensation current is output to the sensing line by using at least one non-display pixel driving circuit when the sensing line senses the output current of the first driving transistor.

The pixel circuit sensing method provided in this exemplary embodiment has the same technical features and operating principles as the pixel circuit described above, which have been described above and will not be described herein again.

Figure 3:
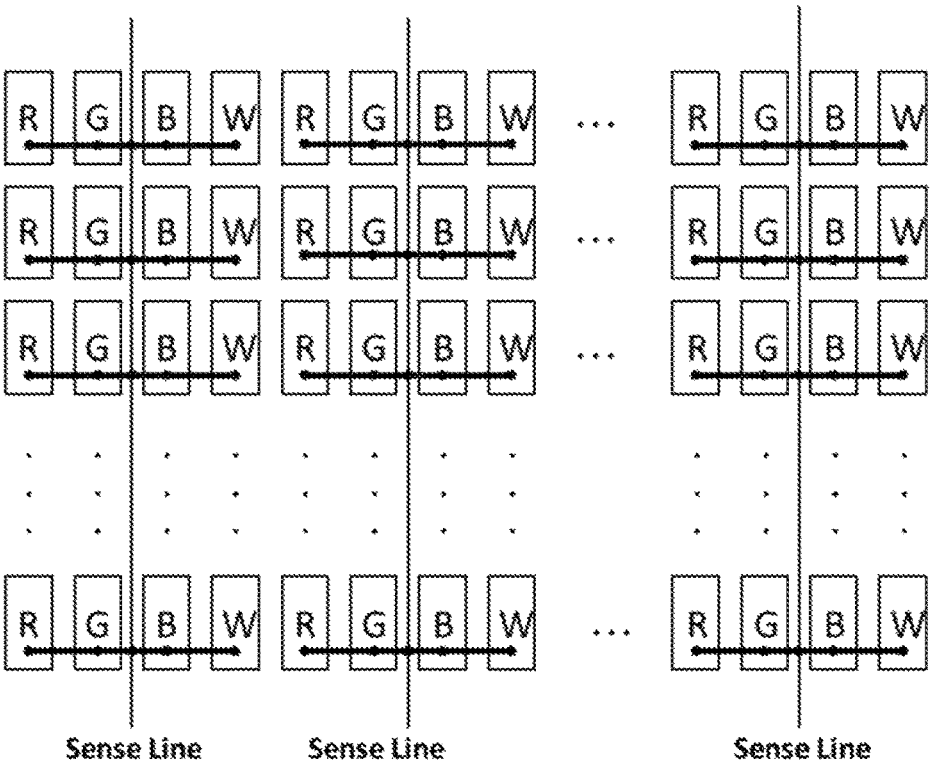
FIG. 3 is a schematic structural diagram of pixel sensing in a display panel in the related art.

As shown in FIG. 3, which is a schematic structural diagram of pixel sensing in a display panel in the related art, the display panel includes a plurality of display pixels arranged in rows and columns, each of the display pixels includes four display sub-pixels R, G, B, and W, and a plurality of display sub-pixels in each of the display pixels are coupled to the same sensing line Sense Line. Since the driving transistor in the display pixel driving circuit that drives the display sub-pixels has a small output current during sensing, the analog-to-digital converter coupled to the sensing line cannot sense the output current of the driving transistor.

Based on this, the present exemplary embodiment also provides a display panel including the above-described pixel circuit.

The display panel provided by the exemplary embodiment has the same technical features and working principles as the above-mentioned pixel circuit, which have been described above and will not be described herein again.

Figure 4:
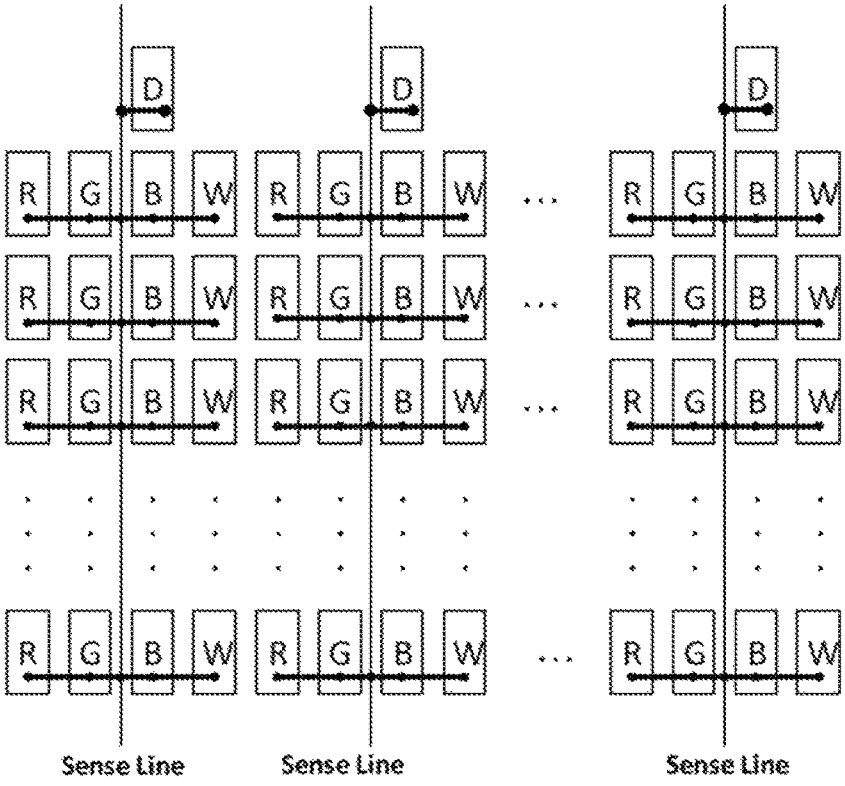
FIG. 4 is a diagram of a distribution structure of pixels in a display panel according to one or more embodiments of the present disclosure.

In the present exemplary embodiment, as shown in FIG. 4, which is a diagram of a distribution structure of pixels in an exemplary embodiment of the display panel of the present disclosure, the display panel may include a plurality of display pixels arranged in rows and columns, each of the display pixels includes four display sub-pixels, a plurality of display sub-pixels in each of the display pixels are coupled to the same sensing line Sense Line, and one sensing line is coupled to one non-display sub-pixel D. In the present exemplary embodiment, since the sensing line Sense Line is arranged in a column direction, in order to avoid overlapping of the lines, the non-display sub-pixels D may be arranged in a row at an upper portion of the display pixels, and may be arranged in columns with the display sub-pixels. It should be understood that the non-display sub-pixels D may also be arranged in a row at a lower portion of the display pixels or at any position on the display panel; in other exemplary embodiments, each of the display pixels may further include three sub-pixels R, G, B, these are all within the protection scope of the present disclosure.

Figure 5:
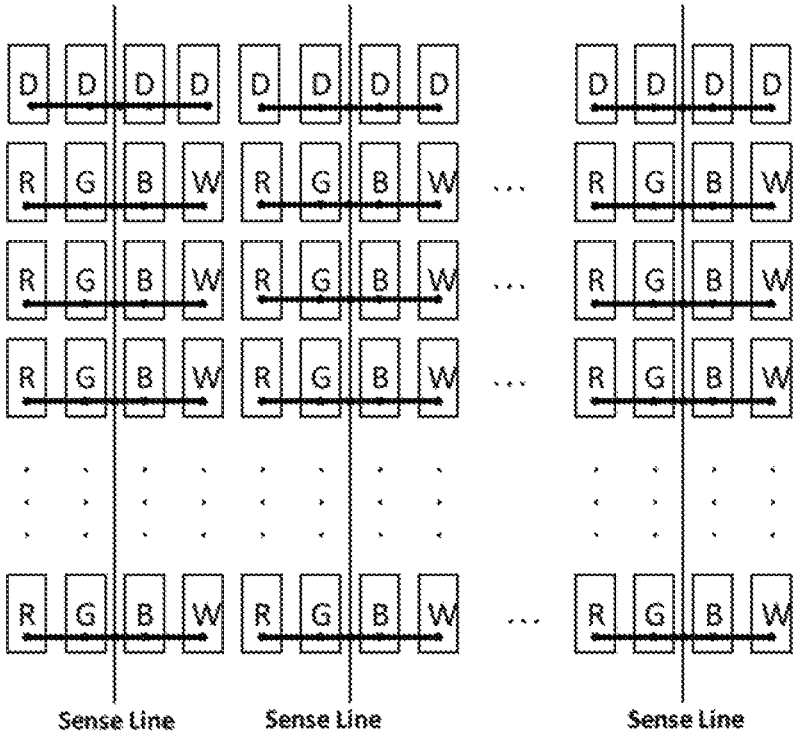
FIG. 5 is a diagram of a distribution structure of pixels in a display panel according to one or more embodiments of the present disclosure.

In other exemplary embodiments, as shown in FIG. 5, which is a diagram of a distribution structure of pixels in another exemplary embodiment of the display panel of the present disclosure, the non-display sub-pixels D may be arranged in a row at the upper portion of the display pixels, and the number of non-display sub-pixels may be the same as the number of columns of the display sub-pixels, and the non-display sub-pixels D may be arranged in columns with the display sub-pixels. The non-display sub-pixel D and the display sub-pixels in the same column are coupled to the same sensing line Sense Line. In such design, the driving circuits of the four non-display sub-pixels can simultaneously compensate the sensing line Sense Line when the sensing line Sense Line senses the output current of the driving circuit of the display sub-pixel. In addition in such design, one corresponding non-display sub-pixel D can provide the compensation current to the sensing line Sense Line by changing the driving timing of the non-display sub-pixels D when the sensing line Sense Line senses the output current of each of the display sub-pixels, so that different display sub-pixels can be differentially compensated. It should be understood that the non-display sub-pixels may also be provided in multiple rows, and the number of non-display sub-pixels in each row may also be equal to ½, ⅓, ¼, etc. of the number of display sub-pixels in each row, which are all within the protection scope of the present disclosure.

Figure 6:
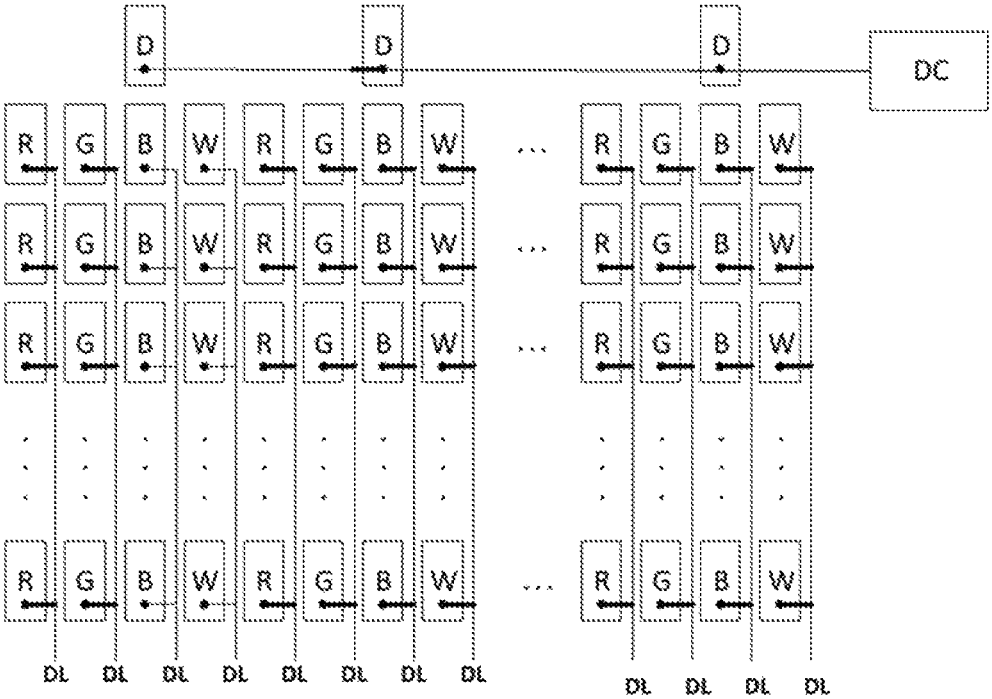
FIG. 6 is a diagram of a distribution structure of pixels in a display panel according to one or more embodiments of the present disclosure.
Figure 7:
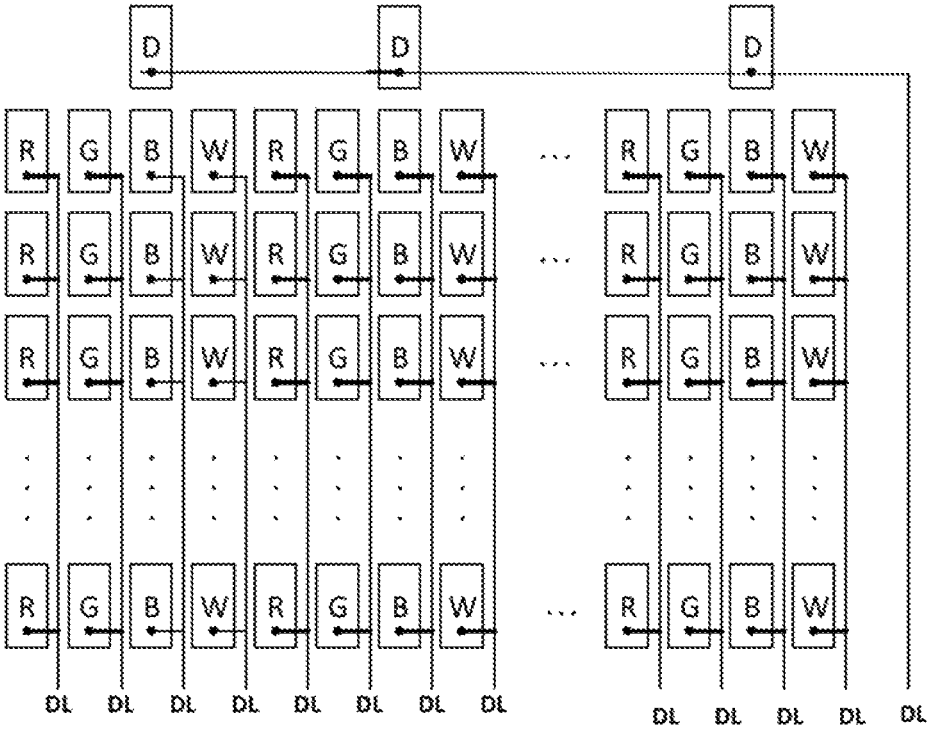
FIG. 7 is a diagram of a distribution structure of pixels in a display panel according to one or more embodiments of the present disclosure.

As shown in FIG. 6, which is a diagram of a distribution structure of pixels in an exemplary embodiment of the display panel of the present disclosure, the connection portion of the sense line Sense Line is omitted in the figure. The display sub-pixels in each column are coupled to one data line DL, and the non-display sub-pixels may be coupled to the same external power source DC, and the external power source DC provides a controllable voltage to the control end of the driving transistor of the non-display sub-pixel. In other exemplary embodiments, as shown in FIG. 7, which is a diagram of a distribution structure of pixels in an exemplary embodiment of the display panel of the present disclosure, the connection portion of the sense line Sense Line is omitted in the figure. The non-display sub-pixel may be coupled to the source driving circuit (not shown) of the display sub-pixel through a data line DL, and the source driving circuit of the display sub-pixel provides the controllable voltage to the control end of the driving transistor of the non-display sub-pixel.

Other embodiments of the present disclosure will be readily apparent to those skilled in the art upon consideration of the specification and practice of the disclosed invention herein. The present application is intended to cover any variations, uses, or adaptations of the present disclosure, which are in accordance with the general principle of the present disclosure and include the common knowledge or conventional technical means in the art that are not disclosed in the present disclosure. The specification and embodiments are to be only considered as illustrative, the true scope and spirit of the present disclosure are set out by appended claims.

The features, structures, or characteristics described above may be combined in any suitable manner in one or more embodiments, and the features discussed in the various embodiments are interchangeable, if possible. In the description above, numerous specific details are set forth to provide a thorough understanding of the embodiments of the present disclosure. However, one skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

What is claimed is:

1. A pixel circuit, comprising:

a display pixel driving circuit configured to drive a display sub-pixel, and comprising a first driving transistor;

a sensing line coupled to an output end of the first driving transistor, and configured to sense a current of the output end of the first driving transistor;

at least one non-display pixel driving circuit configured to drive one non-display sub-pixel, and comprising a second driving transistor with an output end coupled to the sensing line to input a compensation current to the sensing line; and a controllable voltage source coupled to a control end of the second driving transistor, and configured to control the output end of the second driving transistor to output the compensation current, wherein the voltage of the controllable voltage source is large enough to allow a sum of the compensation current and the current of the output end of the first driving transistor to be within a sensing range of a digital-to-analog converter coupled to the sensing line.

2. The pixel circuit according to claim 1, wherein the display pixel driving circuit has a same circuit structure as the non-display pixel driving circuit, and a voltage of the controllable voltage source is small enough to prevent a light emitting unit coupled to the output end of the second driving transistor of the non-display pixel driving circuit from emitting light.

3. The pixel circuit according to claim 1, wherein the output end of the second driving transistor of the non-display pixel driving circuit is not coupled to a light emitting unit.

4. The pixel circuit according to claim 1, wherein the controllable voltage source is provided by a source driving circuit of the display sub-pixel or an external power source.

5. The pixel circuit according to claim 1, wherein the second driving transistor is driven to supply the compensation current to the sensing line when the sensing line senses an output current of the first driving transistor.

6. The pixel circuit according to claim 2, wherein a minimal voltage allowing the light emitting unit of the non-display pixel driving circuit to emit light is larger than that allowing a light emitting unit coupled to the output end of the first driving transistor of the display pixel driving circuit to emit light.

7. A sensing method for a pixel circuit, comprising:

providing the pixel circuit, the pixel circuit comprising:

a display pixel driving circuit configured to drive a display sub-pixel, and comprising a first driving transistor;

a sensing line coupled to an output end of the first driving transistor, and configured to sense a current of the output end of the first driving transistor;

at least one non-display pixel driving circuit configured to drive one non-display sub-pixel, and comprising a second driving transistor with an output end coupled to the sensing line to input a compensation current to the sensing line; and a controllable voltage source coupled to a control end of the second driving transistor, and configured to control the output end of the second driving transistor to output the compensation current; and sensing a current sum of the current of the output end of the first driving transistor and the compensation current input to the sensing line, wherein the voltage of the controllable voltage source is controlled to be large enough to allow a sum of the compensation current and the current of the output end of the first driving transistor to be within a sensing range of a digital-to-analog converter coupled to the sensing line.

8. The sensing method according to claim 7, wherein the sensing method further comprises: determining the current of the output end of the first driving transistor as a difference between the current sum and the compensation current.

9. A display panel, comprising a pixel circuit, wherein the pixel circuit comprises:

a display pixel driving circuit configured to drive a display sub-pixel, and comprising a first driving transistor;

a sensing line coupled to an output end of the first driving transistor, and configured to sense a current of the output end of the first driving transistor;

at least one non-display pixel driving circuit configured to drive one non-display sub-pixel, and comprising a second driving transistor with an output end coupled to the sensing line to input a compensation current to the sensing line; and a controllable voltage source coupled to a control end of the second driving transistor, and configured to control the output end of the second driving transistor to output the compensation current, wherein the voltage of the controllable voltage source is large enough to allow a sum of the compensation current and the current of the output end of the first driving transistor to be within a sensing range of a digital-to-analog converter coupled to the sensing line.

10. The display panel according to claim 9, wherein:

the display panel comprises a plurality of display pixels arranged in rows and columns;

each of the display pixels comprises a plurality of display sub-pixels;

the plurality of display sub-pixels in each of the display pixels are coupled to a same sensing line; and one sensing line is coupled to at least one non-display sub-pixel.

11. The display panel according to claim 10, wherein the display panel comprises at least one row of non-display sub-pixels, and a number of the non-display sub-pixels in each row is equal to the number of the display sub-pixels in each row.

12. The display panel according to claim 10, wherein the display panel comprises at least one row of non-display sub-pixels, and a number of the non-display sub-pixels in each row is equal to ½, ⅓, or ¼ of the number of the display sub-pixels in each row.

13. The display panel according to claim 9, wherein the display pixel driving circuit has a same circuit structure as the non-display pixel driving circuit, and a voltage of the controllable voltage source is small enough to prevent a light emitting unit coupled to the output end of the second driving transistor of the non-display pixel driving circuit from emitting light.

14. The display panel according to claim 13, wherein a minimal voltage allowing the light emitting unit in the non-display pixel driving circuit to emit light is larger than that allowing a light emitting unit coupled to the output end of the first driving transistor of the display pixel driving circuit to emit light.

15. The display panel according to claim 9, wherein the output end of the second driving transistor of the non-display pixel driving circuit is not coupled to a light emitting unit.

16. The display panel according to claim 9, wherein the controllable voltage source is provided by a source driving circuit of the display sub-pixel or an external power source.

* * * * *